US005149480A

United States Patent [19]

Cuculo et al.

[11] Patent Number: 5,149,480

[45] Date of Patent: Sep. 22, 1992

[54] MELT SPINNING OF ULTRA-ORIENTED CRYSTALLINE POLYESTER FILAMENTS

[75] Inventors: John A. Cuculo; Paul A. Tucker, both of Raleigh, N.C.; Gao-Yuan Chen, Chester, Va.; Ferdinand Lundberg, Raleigh, N.C.

[73] Assignee: North Carolina State University, Raleigh, N.C.

[21] Appl. No.: 525,874

[22] Filed: May 18, 1990

[51] Int. Cl.[5] ..... D01D 6/62

[52] U.S. Cl. ..... 264/178 F; 264/181; 264/210.8; 264/211.14; 264/211.17

[58] Field of Search ..... 264/181, 178 F, 210.8, 264/211.17, 211.14

[56] References Cited

U.S. PATENT DOCUMENTS

| | | | |
|---|---|---|---|
| 3,002,804 | 10/1961 | Kilian | 18/54 |
| 4,134,882 | 1/1979 | Franfort et al. | 528/309 |
| 4,425,293 | 1/1984 | Vassilatos | 264/237 |
| 4,446,299 | 5/1984 | Koschinek et al. | 264/103 |
| 4,909,976 | 3/1990 | Cuculo et al. | 264/211.15 |

FOREIGN PATENT DOCUMENTS

| | | | |
|---|---|---|---|
| 0670932 | 9/1963 | Canada | 264/181 |

OTHER PUBLICATIONS

T. Kawaguchi, *Industrial Aspects of High-Speed Spinning*, Chapter 3, "Industrial View on High-Speed Spinning", pp. 8-15.

*Primary Examiner*—Hubert C. Lorin

[57] ABSTRACT

Ultra-oriented, crystalline synthetic filaments with high tenacity are produced by extrusion of a fiber-forming synthetic polymer melt into a liquid isothermal bath maintained at a temperature of at least 30° C. above the glass transition temperature of the polymer, withdrawing the filaments from the bath and then winding up the filaments. Polyethylene terephthalate filaments so produced at 3000-5000 m/min exhibit a crystalline structure and possess birefringence of 0.20-0.22, tenacity of 7-9 g/d, break elongation of 14%-30% and boil-off shrinkage of 5%-10%.

10 Claims, 4 Drawing Sheets

MELT SPINNING OF ULTRA-ORIENTED CRYSTALLINE POLYESTER FILAMENTS

This invention was made with Government support under NSF Grant No. BCS 880 1339-01. The Government has certain rights in this invention.

BACKGROUND OF THE INVENTION

This invention relates to a melt spinning process for production of fully oriented crystalline synthetic filaments with high mechanical properties. More specifically, the present invention provides an improved process for melt spinning fiber-forming synthetic polymers which produces filaments with a very high degree of orientation, high crystallinity, low shrinkage, and high tenacity.

The typical melt spinning processes used commercially in the production of filaments or fibers from fiber-forming synthetic polymers may be characterized as two-step processes. The molten polymer is extruded through spinneret holes to form filaments, and then in a separate step, performed either in-line coupled with the extrusion step or in a separate subsequent operation, the filaments are stretched or drawn to increase the orientation and impart the desired physical properties. For example, commercial polyester filaments, such as polyethylene terephthalate (PET), have for many years been produced by a two step process in which the polymer melt is extruded through a spinneret to form filaments and after solidification, the filaments are wound up at speeds on the order of 1000 to 1500 m/min. The as-spun fibers are then subjected to drawing and annealing at speeds on the order of 400 to 1000 m/min. The handling, energy and capital equipment requirements for such two-step processes contribute significantly to the overall production cost.

In order to reduce production cost and increase production rate, it would be desirable to develop a process for producing fully oriented crystalline PET fibers in a single step with properties equivalent to or better than those produced by the conventional two-step processes. To this end, a number of researchers have explored technology based on high speed spinning. In 1979, DuPont [R. E. Frankfort and B. H. Knox, U.S. Pat. No. 4,134,882] documented a process based on high speed spinning technology at speeds up to about 7000 m/min, providing oriented crystalline PET filaments in one step having good thermal stability and good dyeing properties. However, the fibers have mechanical properties still inferior to those of fully drawn yarns produced by the conventional two-step process.

Parallel to the above study, reports on high speed spinning research can be found elsewhere in the literature since the late 1970's. Properties and structure of high speed spun PET fibers are well characterized. Typical characteristics of high speed spun fibers are lower tenacity, lower Young's modulus and greater elongation as compared with conventional fully oriented yarns [T. Kawaguchi, in "High Speed Fiber Spinning", A. Ziabicki and H. Kawai, Eds John Wiley & Sons, New York, 1985, p. 8]. More recently, a take-up speed up to 12,000 m/min for spinning PET has been reported. But, heretofore it has not been possible to produce as-spun PET fibers by superhigh speed spinning that have properties equivalent to those of conventional two-step spun fibers. Moreover, the orientation and crystallinity of as-spun fibers, respectively, reach maximum values at certain critical speeds, above which severe structural defects such as high radial non-uniformity and microvoids start to develop, which materially restrict attainment of high performance fibers.

Our objective in the present invention is similar to that of the above-noted researchers: namely, providing a process for producing fully oriented crystalline fibers in a single step with properties equivalent to or better than those produced by the conventional two-step processes. However, in pursuing this objective, we have departed from the path followed by the above-noted researchers. Instead of continuing the investigation of high speed spinning, this invention modifies the threadline dynamics of the spinning operation to produce high performance fibers in a one-step process.

It was revealed in our previous work [Cuculo, et al. U.S. Pat. No. 4,909,976, granted Mar. 20, 1990] that fiber structure (orientation and crystallization) development along the fiber spinning threadline can be significantly enhanced by optimizing the threadline temperature profile. This was achieved by introducing a zone cooling and zone heating technique to alter the temperature profile of the spinning threadline to enhance the structure formation. Take-up stress remained almost unchanged as compared with that of conventional spinning.

SUMMARY OF THE INVENTION

Unlike our previous work, the process of the present invention alters both the stress and the temperature profiles of the spinning threadline, simultaneously. Stress is provided in the threadline in the area where the structure of the filaments is developing to achieve a high level of orientation in the filaments. Also, the threadline in this zone is maintained at a temperature selected for optimum crystallization and radial uniformity. The filaments thus produced possess two typical characteristics: high birefringence indicative of a high level of molecular orientation, and a radially uniform fine structure. Filaments with these characteristics possess high tenacity values, low elongation at break, and low boil-off shrinkage.

The present invention is a one-step process that provides ultra-oriented, high tenacity fibers from fiber-forming thermoplastic polymers such as polyethylene terephthalate (PET). Specifically, molten fiber-forming thermoplastic polymer is extruded in the form of filaments, and the filaments are directed into a liquid bath which is maintained at a temperature at least 30° C. above the glass transition temperature of the thermoplastic polymer to provide isothermal crystallization conditions for the filaments in the bath. The filaments are withdrawn from the bath and then wound up at speeds on the order of 3000–7000 m/min. The filaments possess a crystalline structure and a birefringence on the order of 0.20–0.22, with high tenacity of 7–9 g/d, a break elongation of 14–30% and boil-off shrinkage of 5–10%. The filaments are also characterized by having a high level of radial uniformity, and in particular, high radial uniformity of birefringence.

Liquid quench baths have been used in other prior art processes in connection with melt spinning operations, but the function of the liquid quench bath in the present invention and the results achieved in accordance with this invention differ significantly from the prior art processes. For example, in Vassilatos U.S. Pat. No. 4,425,293 (1984), a liquid quench bath is employed using room temperature water to achieve rapid quenching for suppression of polymer crystallization. In contrast, the liquid bath in the present invention is maintained at conditions designed to avoid rapid quench so that an isothermal condition is assured for maximizing crystallization in the threadline.

Koschinek, et al. U.S. Pat. No. 4,446,299 (1984) discloses a process in which filaments are first cooled to a temperature below the adhesive limit (normally equivalent to $T_g$) and are then collected into a bundle and passed into a so called "frictional tension-increasing device", which uses either blown or quiescent air. The filaments may then be treated with a separate high temperature conditioning zone. The present invention does not require the cooling of the molten filaments below the adhesive limit before entering the bath; instead, the filament is immersed in a liquid medium at high temperature while it is still in the molten state (or at least 30 degrees above $T_g$). An additional conditioning zone is not used in the present invention. Besides, the spinning stress achieved in the Koschinek, et al. process is only a few percent of that obtained in the present invention; and more importantly, the excellent physical properties obtained in accordance with the present invention are not achieved by this prior art process.

J. J. Kilian, in U.S. Pat. No. 3,002,804, employed a water bath maintained at a temperature of 80°-90° C. for the purpose of drawing freshly spun filaments into uniform oriented filaments. The filaments may become oriented due to the cold drawing effect; but the crystallization of the filaments is suppressed by the liquid in the temperature range given. An oriented filament without crystallinity ordinarily has poor thermal stability such as high boil-off shrinkage and still needs post-treatment before it can become useful. Although Kilian obtained a maximum tenacity of 7.7 g/d at an extremely long depth (ten feet) of water at 88° C., the mechanical properties of most of his product are inferior to those of conventional fully-drawn yarns. On the other hand, the present invention provides crystalline PET filaments with a birefringence approaching the intrinsic value of PET crystals. The filaments are thermally stable with low level of boil-off shrinkage and can be directly used in textile applications where high tenacity fibers are required without requiring post-treatment.

DESCRIPTION OF THE DRAWINGS

Some of the features and advantages of the invention having been stated, further features and advantages will become apparent from the detailed description which follows and from the accompanying drawings, in which.

DETAILED DESCRIPTION OF THE INVENTION

The present invention involves a process that is different from traditional melt spinning. Traditional melt spinning involves the extrusion of a polymer melt through spinneret holes, cooling of the extrudate with quench air to room temperature and winding up of the solidified filament for post-treatment to achieve desired mechanical properties. This invention employs a liquid isothermal bath in the spinning line at a location below the spinneret face.

The extrudate is directed into the liquid isothermal bath while it is still in a molten state or at least 30° C. above the glass transition temperature of the polymer. The bath temperature should be maintained at a temperature at least 30° C. above the polymer glass transition temperature ($T_g$) to assure sufficient mobility of molecules for crystallization to proceed. Filaments in the bath undergo isothermal orientation at a high rate. The liquid medium in the bath not only provides an isothermal crystallization condition, which contributes to the radial uniformity of the filament structure, but also adds frictional drag, thus exerting a take-up stress on the running filaments which contributes to high molecular orientation. The level of take-up stress on the threadline depends on several factors such as liquid temperature, viscosity, depth and relative velocity between filaments and liquid medium. Preferably, in accordance with the present invention the take-up stress is maintained within the range of 0.6 to 6 g/d (grams per denier), and most desirably within the range of 1-5 g/d.

Table I presents a set of data showing the take-up stress at different speeds and liquid depths. The level of take-up stress of the spinning with the liquid bath is substantially greater than that of spinning with air medium only (zero liquid depth). The take-up stress (ratio of tensile force to filament diameter or linear density) at 3000 m/min reaches 3.2 g/d (or 2.88 g/dtex) at a liquid bath length of 40 cm, compared with a value of 0.22 g/d (or 0.198 g/dtex) for spinning without the liquid bath i.e., with air only as frictional medium. This implies that the take-up stress in the liquid bath spinning line is generated mainly by liquid drag. Because of its high frictional effect as well as its high density, high heat capacity and high heat conductivity coefficient compared with air medium, a liquid medium is often employed as an efficient means for rapid quenching or heating or exerting high frictional force on a running filament in melt spinning or in a drawing process.

TABLE I

Take-up Stress of PET Spinning*

| Depth of Liquid cm | Speed (m/min) 2000 g/d | 2500 g/d | 3000 g/d |
|---|---|---|---|
| 0 | 0.1 | 0.16 | 0.22 |
| 10 | 0.84 | 1.0 | 1.26 |
| 17 | 1.2 | 1.44 | 1.9 |
| 24 | 1.44 | 1.8 | 2.3 |
| 32 | 1.74 | 2.2 | 2.8 |
| 40 | 2.0 | 2.44 | 3.2 |

*0.95 IV PET, Liquid at 120° C., 5.0 denier.

Figure 1:
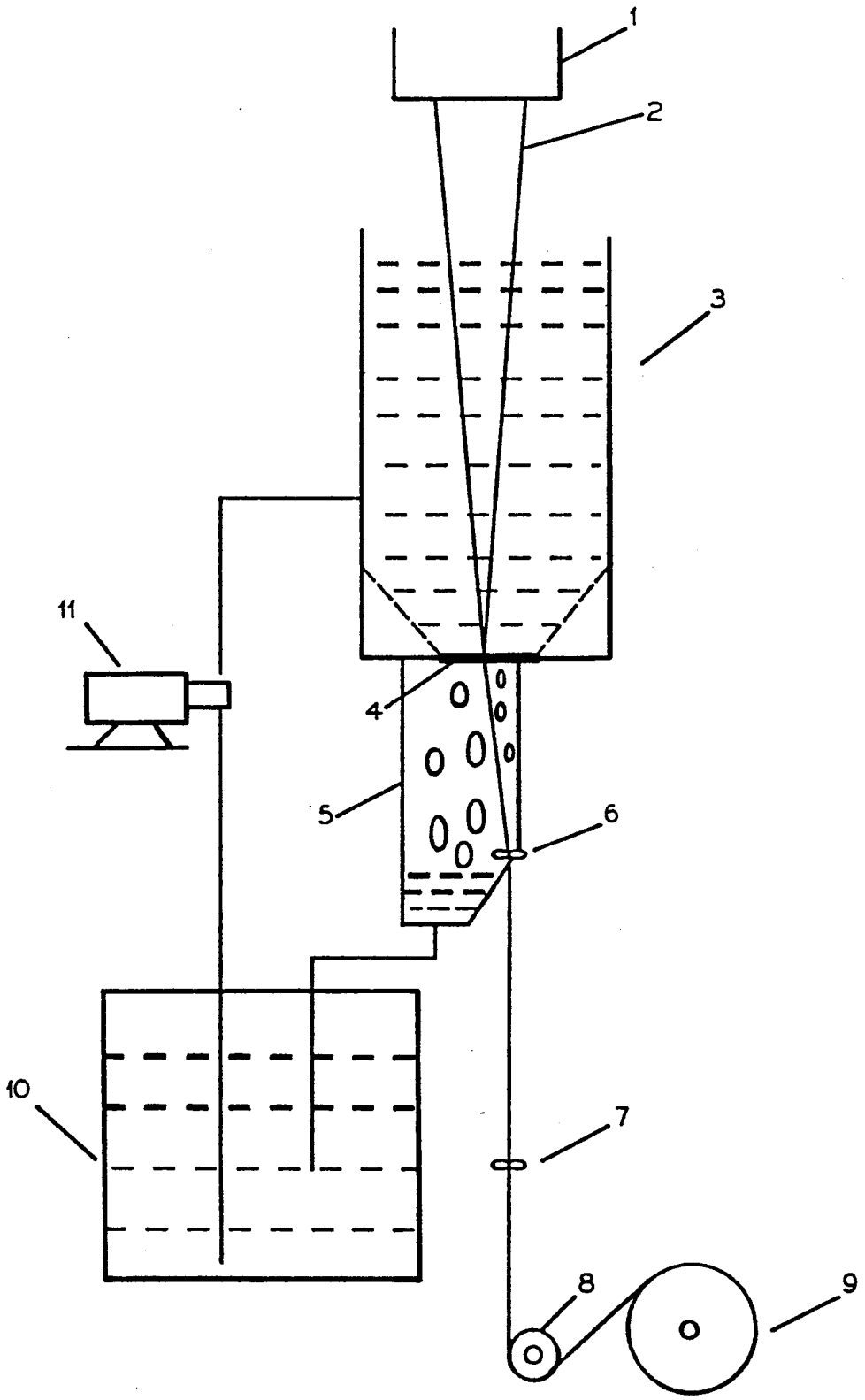
FIG. 1 is a schematic representation of an apparatus capable of practicing the process and producing the product of the present invention.

One typical arrangement of the experimental set-up of this invention is illustrated in FIG. 1. Thermoplastic polymers such as PET are melted and extruded through spinneret 1 with a single or multiple holes. After the extrudate 2 passes through an air gap while still in the molten state or at a temperature at least 30° C. above $T_g$, it is then directed into a liquid isothermal bath 3. The liquid bath should be kept at a temperature at least 30° C. above the glass transition temperature ($T_g$) of the polymer. For PET the preferable range is 120°-180° C. The crystallized solid filament is then pulled out through an aperture with a sliding valve 4 in the bottom of the liquid isothermal bath, passes through a closed liquid-catching device 5, through guides 6,7, around a godet 8, and is ultimately wound up with a take-up device 9 at a winding speed of at least 3000 m/min. The sliding valve 4 is designed so that it can be opened for fast drainage of liquid from the liquid isothermal bath 3 to a reservoir 10 and for ease of free passage of the filaments through the bath before being fed onto the winder 9. After the filaments are threaded and taken up by the winder 9, the valve 4 is then closed leaving an orifice at the center just large enough to allow the filament bundle to pass through freely. The liquid isothermal bath 3 is then filled with a selected liquid, which is preheated in the reservoir 10. The liquid is maintained in the liquid isothermal bath 3 at a desired constant level and a constant temperature. The liquid-catching device 5, attached directly below the liquid isothermal bath, can be readily moved back and forth allowing ease of filament threading and can be closed to catch the small stream and the flying drops of the hot liquid carried along by the filament bundle through the bottom orifice. The as-spun PET fibers obtained under the above said conditions exhibit birefringence value of 0.20–0.22, tenacity of 7.0–9.0 g/d, elongation at break of 14–30%, initial modulus of 75–90 g/d, and boil-off shrinkage of 5–10%.

Characterization Methods

In the examples which follow, the following characterization methods were employed in determining the reported physical properties.

(a) Birefringence. Fiber birefringence was determined using a 20-order tilting compensator mounted in a Nikon polarizing microscope. An average of five individual determinations was reported for each sample.

(b) Tensile test. Tensile tests were performed on an Instron machine model 1123 on single filaments using a gage length of 25.4 mm and an extension rate of about 100% elongation per minute. Average tenacity, modulus and elongation at break of five individual tests were determined using the method described in test method ASTM D3822-82.

(c) Boil-Off shrinkage (BOS). Boil-off shrinkage was determined by immersing fiber samples in boiling water for five minutes without tension. Average BOS of about 10 filaments was calculated according to the method described in test method ASTM D2102-79.

(d) X-ray diffraction. Equatorial scans of a bundle of fibers aligned parallel to each other were obtained using a Siemens Type-F X-ray diffractometer system. Crystalline PET fibers show resolved diffraction peaks whereas amorphous samples do not.

(e) Take-up Tension. Take-up force was measured at a point near the take-up device using a Rothsohild Tensiometer calibrated at 50 grams full scale.

The present invention is further illustrated by the following examples.

EXAMPLES 1–5

A high intrinsic viscosity (IV) industrial grade polyethylene terephthalate polymer (IV of 0.95) was melt extruded at 295° C. through a hyperbolic die with 0.6 mm exit diameter. Polymer throughput was varied with take-up speed to obtain a constant linear density of about 5.0 denier per filament.

Examples 1 and 2 were produced using an apparatus arrangement of the type shown schematically in the drawing. 1,2-propanediol was used as the liquid medium for the liquid isothermal bath, which was maintained at temperatures of 110° C. and 136° C., respectively, for spinning Examples 1 and 2. Example 1 was wound up at a speed of 3000 m/min and Example 2 at 4000 m/min.

Comparative Example 3 was prepared using the same conditions as in 1 and 2 except that room temperature water was used as the liquid medium. Comparative Examples 4 and 5 were produced using the same apparatus except that no liquid bath was employed, i.e., spinning tension was built up by the usual or normal drag of air surrounding the filament surface.

Properties of the above examples are listed in Table II. Examples 1 and 2 satisfy the specifications of the present invention set forth earlier herein. Example 3 shows a relatively high birefringence, which is due to the large drag effect of water; but the fiber is essentially amorphous as evidenced by X-ray diffraction and confirmed by the high value of boil-off shrinkage. Tensile properties of this sample do not fall in the specifications of the present invention described herein. Comparative Example 4, spun in air medium at 3000 m/min, shows typical amorphous X-ray patterns, low level of molecular orientation and poor mechanical performance. Comparative Example 5, produced in air at 6000 m/min, shows a crystalline pattern by X-ray diffraction, but has a low birefringence value. The tensile properties do not meet the specifications of the product of the present invention.

TABLE II

Properties of Filaments Spun from 0.95 IV PET

| | Example No. | | | | |
|---|---|---|---|---|---|
| | 1 | 2 | 3 | 4 | 5 |
| Spinning with* | LIB | LIB | LIB | air | air |
| Temperature (°C.) | 110 | 136 | 23 | 23 | 23 |
| Speed (m/min) | 3000 | 4000 | 3500 | 3000 | 6000 |
| Within this inv. | yes | yes | no | no | no |
| Birefringence | 0.213 | 0.214 | 0.18 | 0.048 | 0.031 |
| Tenacity | | | | | |
| (g/d) | 8.1 | 8.8 | 4.0 | 3.2 | 4.3 |
| (MPa) | 971 | 1063 | 483 | 372 | 521 |
| Modulus | | | | | |
| (g/d) | 77 | 82 | 55 | 13 | 51 |
| (GPa) | 9.2 | 9.8 | 6.5 | 1.56 | 6.2 |
| Elongation (%) | 18.9 | 17.9 | 32.8 | 205 | 61.6 |
| Boil-off Shrinkage | 10.3 | 8.9 | 47.1 | 26.9 | 2.5 |
| X-ray Diffraction** | X | X | Am | Am | X |

*LIB = Liquid isothermal bath
**X = crystalline; Am = amorphous

EXAMPLES 6–10

In the series of these examples, a lower molecular weight textile grade PET (0.57 IV) was spun into filaments under conditions similar to those used for Examples 1–5. Results are presented in Table III. Examples 6 and 7 were produced using 1,2-propanediol in the liquid isothermal bath at 120° C., a temperature about 45° C. above $T_g$, yielding filaments in accordance with the present invention, characterized by a crystalline structure and high birefringence, high tenacity, and low elongation and boil-off shrinkage. Comparative Example 8 was made using a water bath at 90° C., a temperature below ($T_g$+30) °C., showing an amorphous structure, with thermal instability and mechanical properties inferior to that of the present invention although it is highly oriented due to frictional drawing at the given temperature. Comparative Examples 9 and 10, produced in air without using a liquid bath, show properties not satisfying the specifications of the product of the present invention.

TABLE III

Properties of Filaments Spun from 0.57 IV PET

| | Example No. | | | | |
|---|---|---|---|---|---|
| | 6 | 7 | 8 | 9 | 10 |
| Spinning with* | LIB | LIB | LIB | air | air |
| Temperature (°C.) | 120 | 120 | 90 | 23 | 23 |
| Speed (m/min) | 3000 | 3500 | 3000 | 3000 | 6000 |
| Within this inv. | yes | yes | no | no | no |
| Birefringence | 0.215 | 0.220 | 0.197 | 0.048 | 0.139 |
| Tenacity | | | | | |
| (g/d) | 7.3 | 8.2 | 5.4 | 3.0 | 4.1 |
| (MPa) | 879 | 9763 | 645 | 354 | 500 |
| Modulus | | | | | |
| (g/d) | 89 | 85 | 71 | 24 | 59 |
| (GPa) | 10.3 | 10.1 | 8.6 | 2.86 | 7.2 |
| Elongation (%) | 21.6 | 14.2 | 34.8 | 150 | 61.6 |
| Boil-off Shrinkage | 8.23 | 6.7 | 27.3 | 45.1 | 2.4 |
| X-ray Diffraction** | X | X | Am | Am | X |

*LIB = Liquid isothermal bath
**X = crystalline; Am = amorphous

Radial Uniformity Measurements

The radial birefringence of the filaments of Example 7 was determined using a Jena interference microscope. The local refractive indices, $n_{||}$ and $n_{\perp}$, parallel and perpendicular to the fiber axis, respectively, were calculated using a shell-model for determination of radial birefringence distribution. Chord-average refractive indices and birefringence were also reported. Lorentz optical density, $k_p$, was determined by the following equation:

$$k_p = \frac{n_{iso}^2 - 1}{n_{iso}^2 + 2}$$

where, $$n_{iso} = \frac{2n_{||} + n_{\perp}}{3}.$$

The analysis of interference fringes was conducted with a completely automated process.

Figure 2:
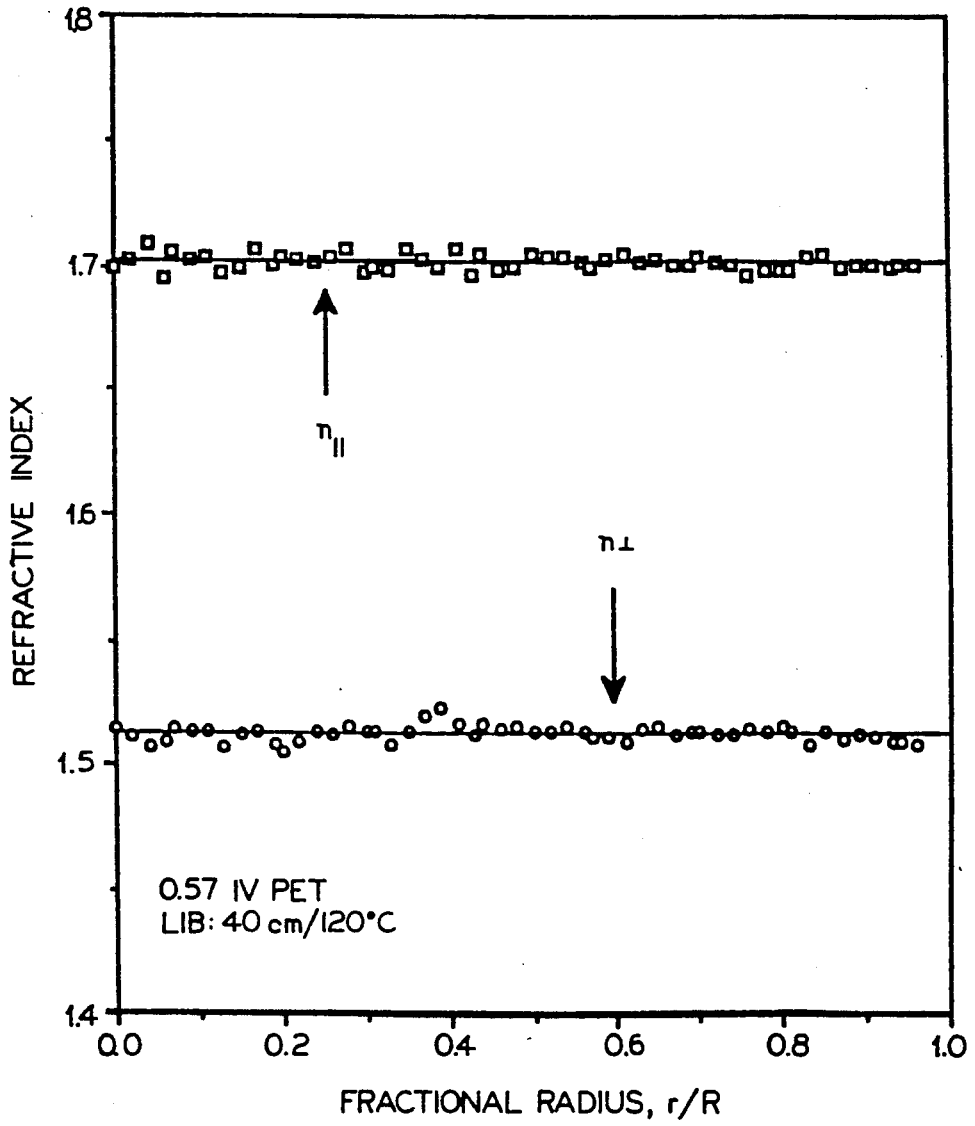
FIGS. 2-6 are graphs illustrating the radial uniformity of refractive index, birefringence, and Lorentz density of filaments produced in accordance with this invention.
Figure 3:
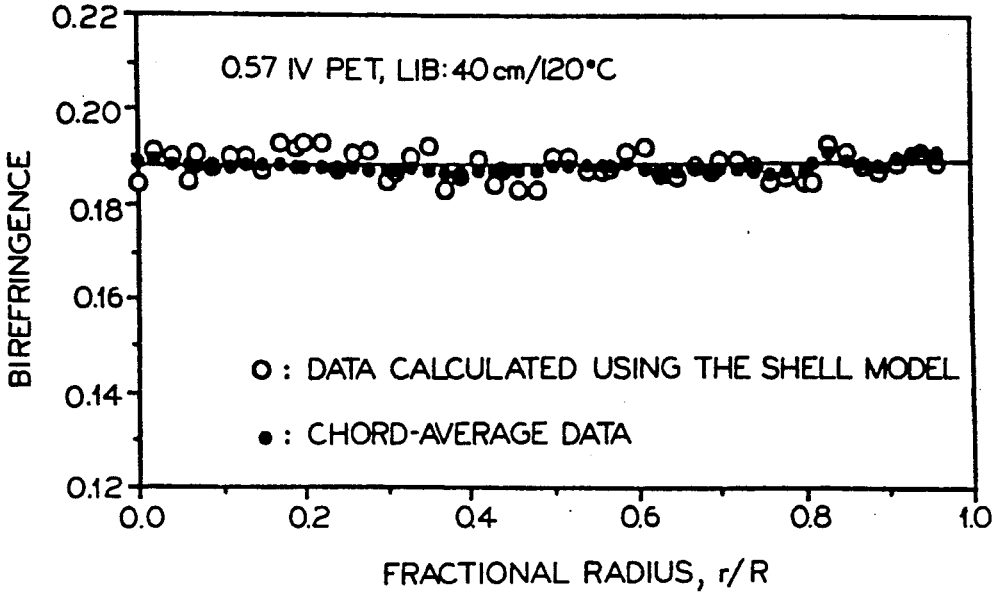
Figure 4:
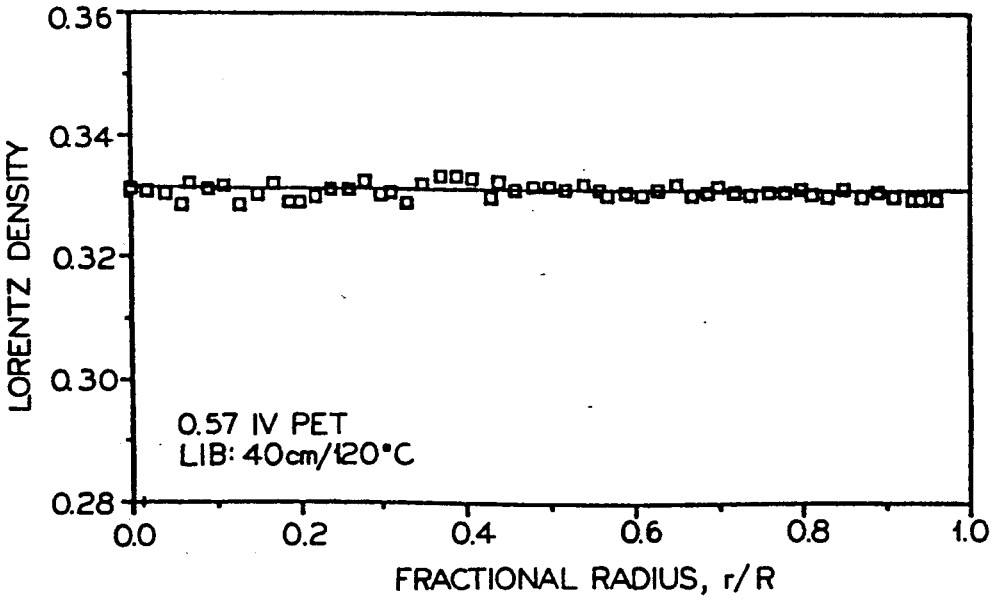

FIG. 2 shows the radial distribution of two refractive indices, $n_{||}$ and $n_{\perp}$, parallel and perpendicular, respectively, to the axis of the fiber of Example 7, which was spun from 0.57 IV PET at 3,500 m/min with a liquid isothermal bath at 120° C. The radial distributions of $n_{||}$ and $n_{\perp}$ and of the fiber are essentially flat. Radial distribution of birefringence is shown in FIG. 3. The filled circles are the chord-average birefringence and the open circles are the "true" local birefringence calculated using the shell-model. FIG. 4 shows the radial distribution of Lorentz (optical) density in the spun filaments. Since the Lorentz density is proportional to the normal density or crystallinity, the flat profile implies that there is a uniform density or crystallinity in the cross section of the filaments.

Figure 5:
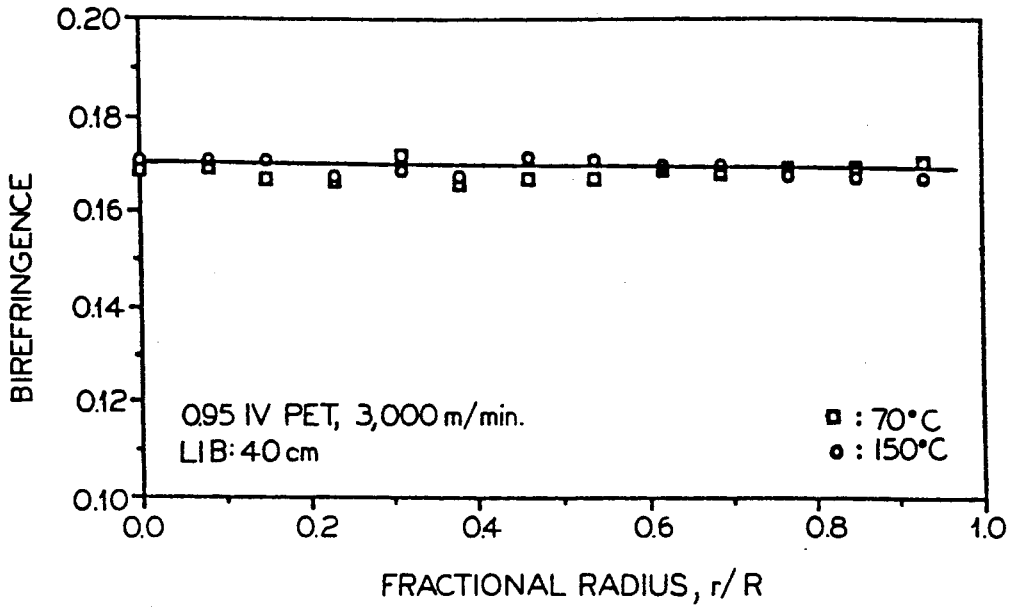
Figure 6:
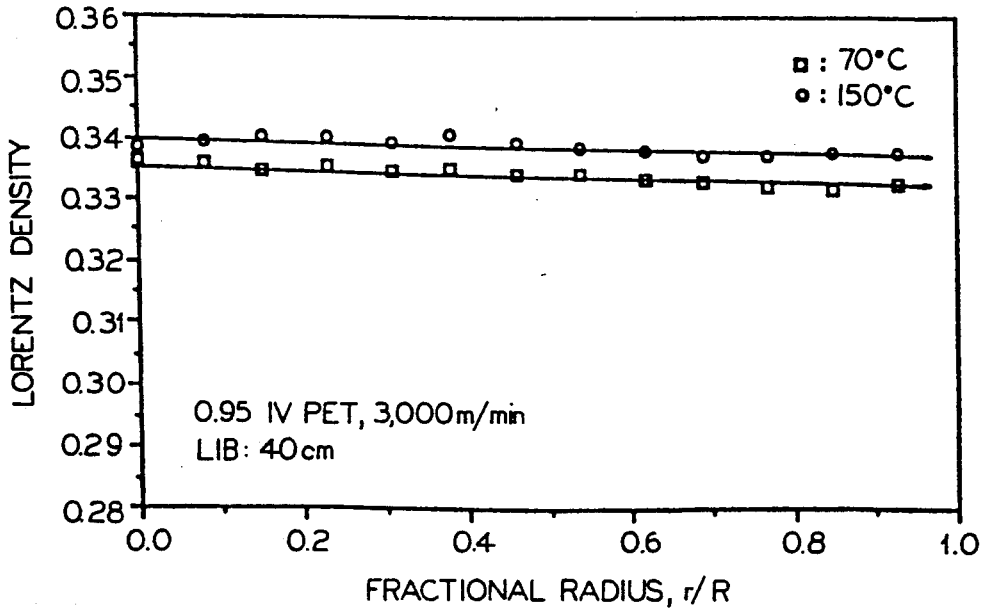

FIG. 5 shows radial birefringence distributions of two fibers spun with the liquid isothermal bath at two different temperatures. The take-up speed used was 3,000 m/min. Radial distributions of the Lorentz optical densities are given in FIG. 6. It is shown that the birefringence and optical density are radially uniform in both samples. Consistent with the normal density measurement, the filaments spun at the higher liquid isothermal bath temperature show higher optical density than that of the sample spun at the lower bath temperature, although the birefringences of the two samples are about the same. These observations again demonstrate that spinning with a liquid isothermal bath can produce filaments with not only a high level of molecular orientation but also a highly uniform radial structure.

These data confirm that an absence of radial temperature gradient in the fiber structure developing zone leads to the elimination of skin-core effect, which is usually encountered in normal high-speed spinning. Although some degree of radial temperature gradient may be present in the upper region of the threadline before the filament enters the liquid isothermal bath, virtually little structure develops in that region because of the low level of spinning stress. After the filament enters the liquid, it can reach the liquid temperature very rapidly and is subject to an isothermal condition in the liquid bath while the fiber structure is being developed. Lack of the radial temperature gradient in the structure developing zone results in a radially uniform fiber structure.

The present invention is not limited by the specific examples given above. The embodiments of the invention also apply to fiber spinning of synthetic polymers other than PET based on the similar principle of polymer crystallization in the high tension threadline. Nylons and polyolefins are two typical examples, which are apparent to those skilled in the art.

That which is claimed is:

1. A one-step process for producing melt spun thermoplastic polymer filaments of high orientation and tenacity, comprising extruding molten fiber-forming thermoplastic polyester polymer in the form of filaments, while directing the thus extruded filaments into a liquid bath, while maintaining the liquid bath at a temperature at least 30° C. above the glass transition temperature of the thermoplastic polymer to provide isothermal crystallization conditions for the filaments in the bath, and while withdrawing the filaments from the bath at a speed of 3000 meters per minute or greater to stress the filaments as they pass through the bath.

2. A process as set forth in claim 1 wherein the filaments are withdrawn at a speed which imparts a take-up stress of 0.6 to 6 g/d in the filaments.

3. A process as set forth in claim 1 wherein said step of directing the filaments into the liquid bath comprises directing the filaments into the liquid bath while they are still at a temperature at least 30° C. above the glass transition temperature of the polymer.

4. A process as set forth in claim 1 wherein the fiber forming polymer is polyethylene terephthalate and said maintaining step comprises maintaining the bath at a temperature of at least 110° C.

5. A process as set forth in claim 4 wherein the bath is maintained at a temperature of about 130° C.

6. A process as set forth in claim 1 including the step of controlling the conditions of the liquid bath and the speed of withdrawing the filaments from the bath so as to achieve a crystalline X-ray diffraction pattern in the filaments and a birefringence of 0.20 or higher.

7. A process as set forth in claim 6 wherein said step of controlling the conditions of the liquid bath and the speed of withdrawing the filaments from the bath comprises maintaining the liquid bath at a temperature of at least 110° C. and withdrawing the filaments from the bath at a speed of 3000 to 7000 m/min to exert a take-up stress on the filaments as they pass through the bath.

8. A one-step process for producing melt spun thermoplastic polymer filaments of high orientation and tenacity, comprising extruding molten fiber-forming thermoplastic polyester polymer in the form of filaments, directing the filaments into a liquid isothermal bath while the filaments are at a temperature at least 30° C. above the glass transition temperature of the polymer, maintaining the liquid isothermal bath at a temperature at least 30° C. above the glass transition temperature of the polymer, stressing the filaments as they pass through the bath to achieve a high rate of orientation and crystallization in the filaments, withdrawing the filaments from the bath at a speed of 3000 meters per minute or greater, and winding the filaments on a take-up.

9. A one-step process for producing melt spun thermoplastic polymer filaments of high orientation and tenacity, comprising extruding molten polyethylene terephthalate polymer through spinneret holes to form filaments, directing the molten filaments into a liquid bath, maintaining the liquid bath at a temperature at least 30° C. above the glass transition temperature of the polyethylene terephthalate polymer to provide isothermal crystallization conditions for the filaments in the bath, and withdrawing the filaments from the bath at a speed of 3000 to 7000 m/min to exert a take-up stress on the filaments as they pass through the bath.

10. A process as set forth in claim 1 wherein the filaments are withdrawn at a speed which imparts a take-up stress of 0.6 to 6 g/d in the filaments.

* * * * *